US005701923A

United States Patent [19]

Losi, Jr. et al.

[11] Patent Number: 5,701,923

[45] Date of Patent: Dec. 30, 1997

[54] COLLAPSIBLE SHELTER

[76] Inventors: Raymond Losi, Jr., 4307 Oak Place Dr., Westlake Village, Calif. 91362; Ming-Liang Tsai, Rm. 3, 4th Floor, No. 8, Fu Ching Street, Taipei, Taiwan

[21] Appl. No.: 773,265

[22] Filed: Dec. 23, 1996

Related U.S. Application Data

[63] Continuation-in-part of Ser. No. 611,511, Mar. 7, 1996, Pat. No. 5,638,853.

[51] Int. Cl.[6] ..... E04H 15/50

[52] U.S. Cl. ..... 135/131; 135/145; 135/151; 403/109; 403/329; 403/377

[58] Field of Search ..... 135/128, 130, 135/131, 143, 144, 145, 146, 151, 135, 114, 115; 403/109, 329, 377

[56] References Cited

U.S. PATENT DOCUMENTS

| | | | |
|---|---|---|---|
| 1,007,322 | 10/1911 | Barnes | 135/141 X |
| 4,026,313 | 5/1977 | Zeigler . | |
| 4,262,460 | 4/1981 | Bertin . | |
| 4,607,656 | 8/1986 | Carter . | |
| 4,689,932 | 9/1987 | Zeigler . | |
| 4,779,635 | 10/1988 | Lynch . | |
| 4,844,106 | 7/1989 | Navarro . | |
| 4,846,204 | 7/1989 | Sok Kyu . | |
| 4,885,891 | 12/1989 | Lynch . | |
| 4,947,884 | 8/1990 | Lynch . | |
| 5,035,253 | 7/1991 | Bortles . | |
| 5,244,001 | 9/1993 | Lynch . | |
| 5,274,980 | 1/1994 | Zeigler . | |
| 5,275,188 | 1/1994 | Tsai . | |
| 5,361,794 | 11/1994 | Brady . | |
| 5,421,356 | 6/1995 | Lynch . | |
| 5,423,341 | 6/1995 | Brady . | |
| 5,444,946 | 8/1995 | Zeigler . | |
| 5,485,863 | 1/1996 | Carter . | |
| 5,490,532 | 2/1996 | Mallookis et al. . | |
| 5,490,533 | 2/1996 | Carter . | |
| 5,511,572 | 4/1996 | Carter | 135/145 |

*Primary Examiner*—Lanna Mai
*Attorney, Agent, or Firm*—Oppenheimer Poms Smith

[57] ABSTRACT

A shelter frame having at least two poles connected by a linking assembly having first and second scissors-type linkages and a linking device. The scissors-type linkages include first structural members pivotally coupled to respective second structural members and to one another. The linking device is adapted to pivotally secure a predetermined portion of the second structural member in the first scissors-type linkage to the second scissors-type linkage at a point on the second scissors-type linkage vertically spaced from the predetermined portion of the second structural member in the first scissors-type linkage and to also pivotally secure a predetermined portion of the second structural member in the second scissors-type linkage to the first scissors-type linkage at a point on the first scissors-type linkage vertically spaced from the predetermined portion of the second structural member in the second scissors-type linkage.

31 Claims, 15 Drawing Sheets

COLLAPSIBLE SHELTER

CROSS-REFERENCE TO RELATED APPLICATION

The present application is a continuation-in-part of U.S. application Ser. No. 08/611,511, filed Mar. 7, 1996 now U.S. Pat. No. 5,638,853.

BACKGROUND OF THE INVENTION

1. Field of Invention

The present invention relates generally to shelters and, more particularly, to shelters including collapsible frames.

2. Description of the Related Art

Over the years, a seemingly endless variety of tents and other shelters having collapsible frames have been introduced into the market. Such structures are commonly used to provide shelter during camping trips, picnics, parties, military operations and other outdoor activities. Because their frames are collapsible, relatively large shelters may be folded into a compact configuration for storage and transport.

The inventors herein have discovered that there are a number of shortcomings associated with the collapsible shelters that have been introduced heretofore. More specifically, the inventors herein have discovered that the frames associated with prior collapsible shelters tend to be difficult to fold and unfold, unstable, and somewhat large when folded. Some prior shelter frames also allow the canopy to sag and form unsightly pockets where water can accumulate, reduce tent headroom and/or ultimately produce an unsightly shelter.

For example, a prior open-type collapsible tent is shown in FIGS. 16 and 17. The tent consists of a frame which supports a canopy D. The frame includes four poles A, each of which is secured to a center strut C by a scissors-type linkage B. The scissors-type linkages B are secured to the poles A by fixed hinges A1 at the top of each pole and sliding hinges A2 which slide along the poles as the frame is moved between the folded and unfolded orientations. The other ends of the linkages B are secured to the center strut C by a fixed cross-shaped connector F and a sliding connector E which slides along the center strut as the frame is moved between the folded and unfolded orientations.

The shelter frame shown in FIGS. 16 and 17 is somewhat unstable because the legs A are not directly connected to one another and, instead, are only connected to one another by the structure formed by the scissors-type linkages B, the center strut C and the connectors E and F. In addition to being unstable, the scissors-type linkage/center strut/connector structure also reduces the headroom within the tent. This frame is also somewhat difficult to unfold in that an extra person is sometimes needed to push the center strut C upwardly to its completely extended position. With respect to the canopy D, the center strut C is the only portion of the frame that holds the canopy above the poles and, as a result, the canopy will often sag.

Another example of a conventional shelter frame is shown in U.S. Pat. No. 4,607,656 ("the '656 patent"). The frame disclosed in the '656 patent is a marginal improvement over the frame illustrated in FIGS. 16 and 17 in that stability is increased because adjacent support poles are connected to one another by respective pairs of scissors-type linkages. Nevertheless, the shelter frame disclosed in the '656 patent suffers from many of the same shortcomings as the frame shown in FIGS. 16 and 17. For example, the canopy is supported by a single central support and, therefore, tends to sag. The central support post is itself supported by a pair of scissors-type linkages which extend across the interior of the shelter. This configuration reduces headroom within the shelter. Moreover, the lowest portion of each of the scissors-type linkage pairs is half way between the poles, thereby reducing headroom in the area that often serves as the entrance to a tent.

OBJECT AND SUMMARY OF THE INVENTION

A general object of the present invention is to provide a collapsible shelter that is superior to those presently known in the art. In particular, one object of the present invention is to provide a shelter frame that is relatively easy to fold and unfold, stable, and still compact when folded. Another object of the present invention is provide a shelter frame that is less likely to allow the canopy to sag, will not reduce tent headroom and will ultimately produce an attractive shelter.

In accordance with one aspect of the present invention, these and other objectives are accomplished by providing a shelter frame having at least two poles connected by a linking assembly having first and second scissors-type linkages and a linking device. The scissors-type linkages include first structural members pivotally coupled to respective second structural members and to one another. The linking device is adapted to pivotally secure a predetermined portion of the second structural member in the first scissors-type linkage to the second scissors-type linkage at a point on the second scissors-type linkage vertically spaced from the predetermined portion of the second structural member in the first scissors-type linkage and to also pivotally secure a predetermined portion of the second structural member in the second scissors-type linkage to the first scissors-type linkage at a point on the first scissors-type linkage vertically spaced from the predetermined portion of the second structural member in the second scissors-type linkage.

The vertical spacing associated with the linking device provides increased headroom between the poles as compared to prior linking assemblies which consist solely of two scissors-type linkages. Moreover, the increased headroom is provided without sacrificing ease of folding and unfolding, stability, and compactness when folded.

In accordance with another aspect of the present invention, other objectives are accomplished by providing a shelter frame with a canopy support including a head connector and at least first and second canopy support rods. Each canopy support rod includes a first rod member pivotally secured to a second rod member. The first rod members are also pivotally secured to a respective pole and the second rod members are also pivotally secured to the head connector. As a result, the canopy support provides a greater support area than many prior canopy supports, which results in an aesthetically pleasing shelter canopy that is less likely to sag. The shelter frame may also include linking rods that are pivotally secured to sliding connectors on the poles and to the canopy support rods. The linking rods help drive the canopy support to its unfolded orientation as the frame poles are pulled apart. As a result, the canopy support need not be manually pushed to its unfolded orientation.

In accordance with still another aspect of the present invention, a sliding connector locking assembly is provided substantially within the interior a pole. The locking assembly includes a spring having first and second spring members extending from a base member, a button associated with the first spring member and adapted to extend through apertures in the pole and sliding connector, and a positioning member adapted to maintain the spring at a predetermined location within the interior of the pole. This assembly makes the frame easier to fabricate and more reliable than those having the locking assemblies known heretofore.

Many other features and attendant advantages of the present invention will become apparent as the invention becomes better understood by reference to the following detailed description considered in conjunction with the accompanying drawings.

BRIEF DESCRIPTION OF THE DRAWINGS

Detailed description of the preferred embodiment of the invention will be made with reference to the accompanying drawings.

DETAILED DESCRIPTION OF THE PREFERRED EMBODIMENT

The following is a detailed description of the best presently known mode of carrying out the invention. This description is not to be taken in a limiting sense, but is made merely for the purpose of illustrating the general principles of the invention. The scope of the invention is defined solely by the appended claims.

Figure 1:
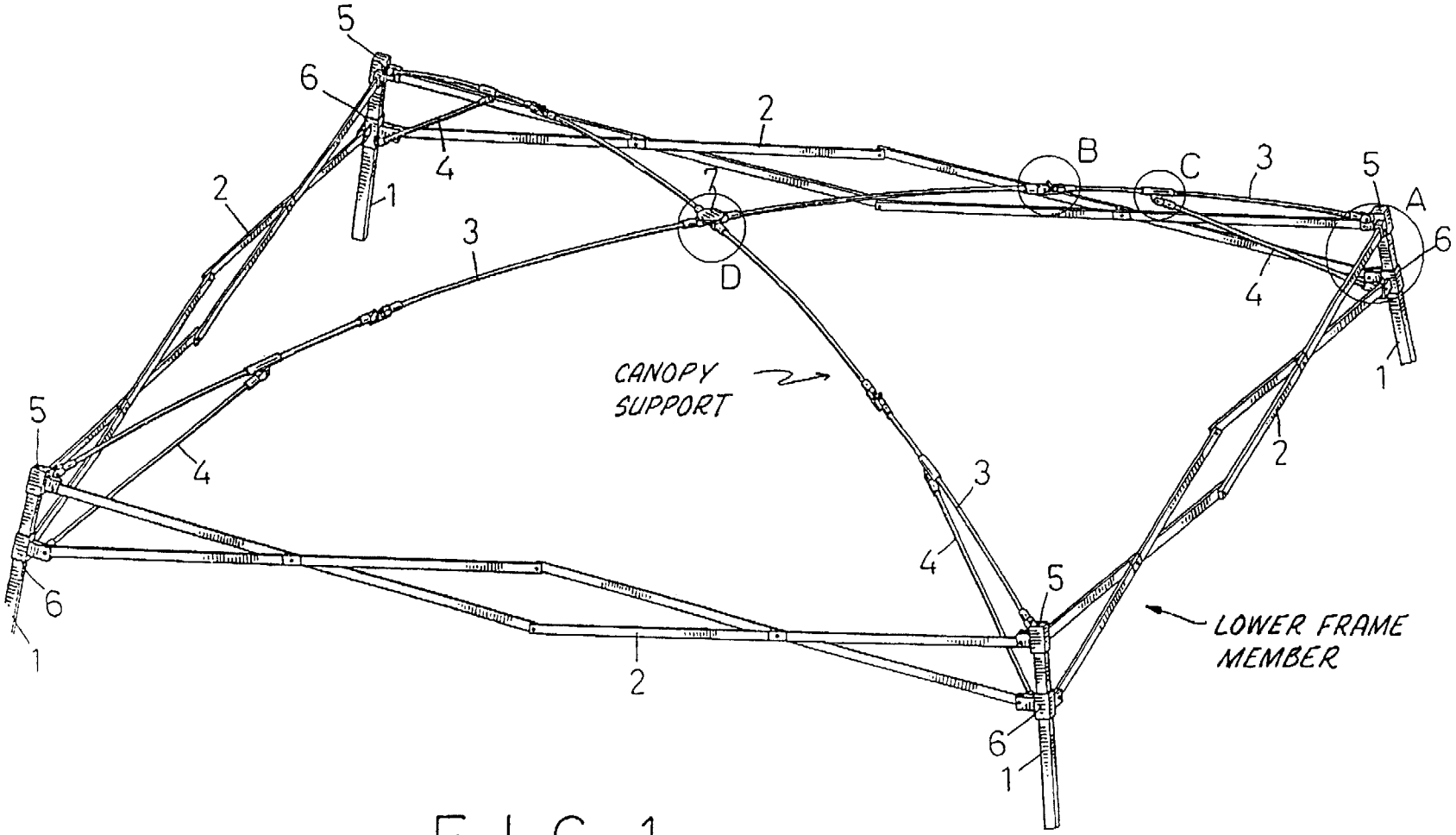
FIG. 1 is a perspective view of a collapsible shelter frame in accordance with a preferred embodiment of the present invention.
Figure 2:
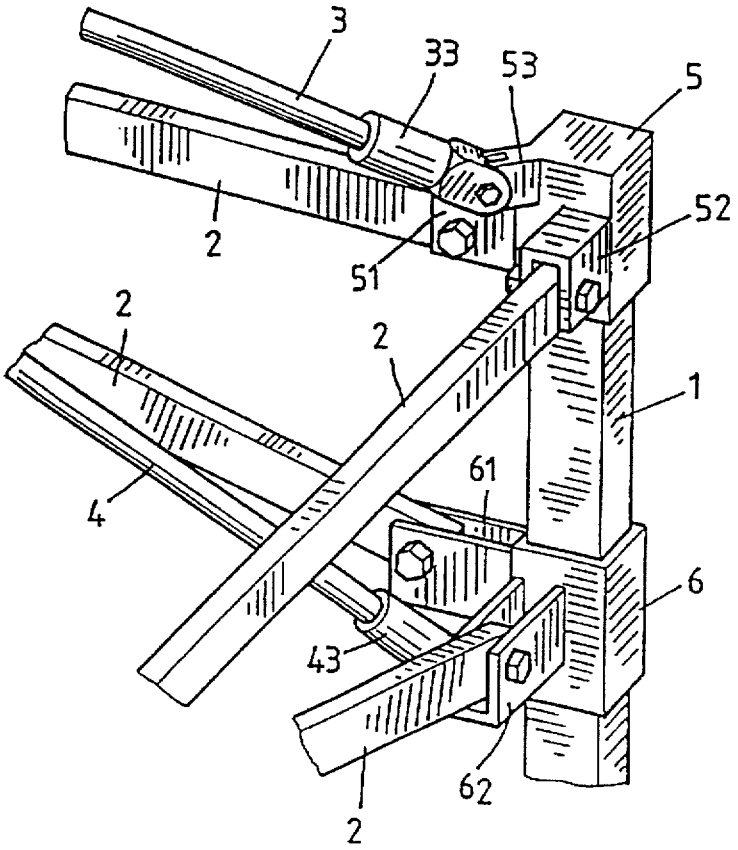
FIG. 2 is an enlarged view of the portion of the preferred embodiment identified by circle A in FIG. 1.

As shown by way of example in FIG. 1, a shelter frame in accordance with a first preferred embodiment of the present invention includes a lower frame member and a canopy support. The lower frame member includes four upwardly extending poles 1 that are connected to one another by four pairs of scissors-type (or x-type) linkages 2. Each of the scissors-type linkages 2 is pivotally secured to another linkage and to one of the poles 1. The linkages 2 are secured to the poles 1 by fixed connectors 5, which are secured to the top of each pole, and sliding connectors 6 which slides along the poles. The exemplary canopy support includes four canopy supporting rods 3, each of which is pivotally secured to a head 7. The canopy supporting rods 3 are also pivotally secured to respective linking rods 4 and fixed connectors 5. The linking rods 4 are pivotally secured to respective sliding connectors 6.

Referring to FIGS. 2, 6, 11 and 12, each exemplary fixed linkage 5 includes three connecting seats 51, 52 and 53. The connecting seats 51 and 52 are secured to the end of a link in a scissors-type linkage 2 by a nut 9 and a bolt 8. The connecting seat 53, which is between connecting seats 51 and 52, is secured to a connector 33 at one end of a canopy supporting rod 3 by a nut 9 and a bolt 8. Similarly, the sliding linkages 6 are provided with three connecting seats 61, 62 and 63. The connecting seats 61 and 62 are also secured to the end of a link in a scissors-type linkage 2 by a nut 9 and a bolt 8. The connecting seat 63, which is between connecting seats 61 and 62, is secured to a connector 43 at the end of a linking rod 4 by a nut 9 and a bolt 8. So configured, the scissors-type linkages 2, canopy supporting rods 3, linking rods 4, and sliding connectors 6 are capable of being moved from the fully open (or unfolded) orientation shown in FIGS. 1, 2 and 6 to the partially folded orientation shown in FIGS. 10, 11 and 12.

Figure 18:
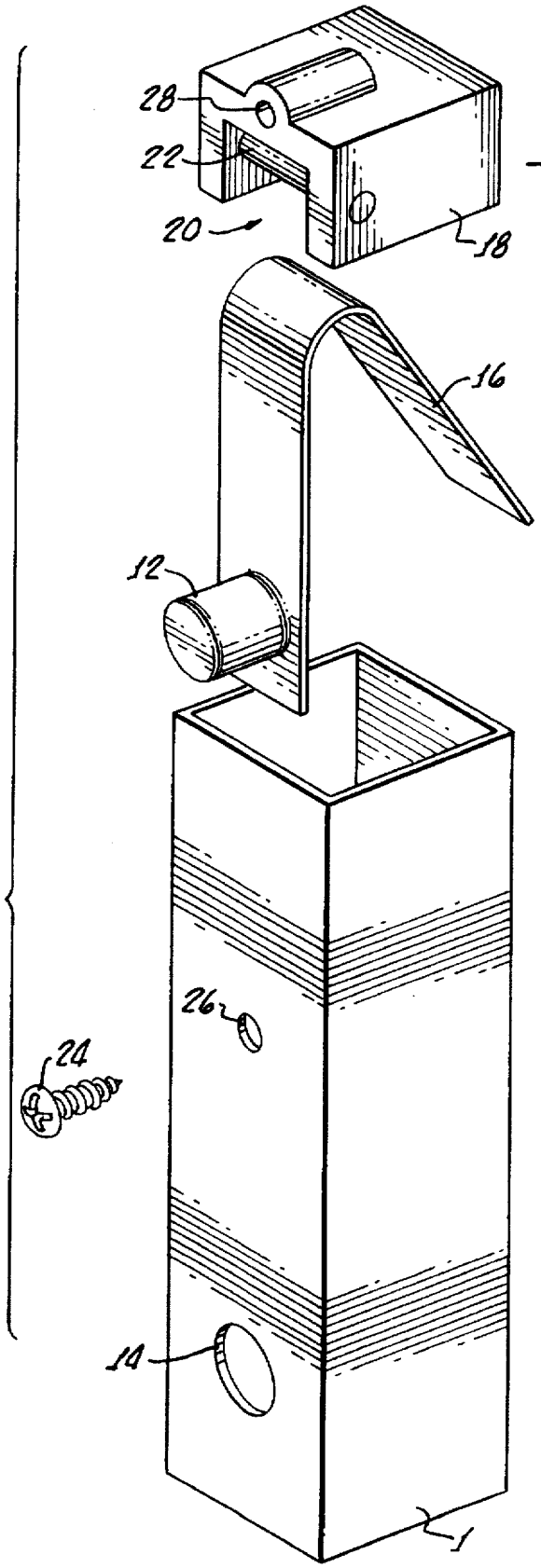
FIG. 18 is a section view of a locking assembly in accordance with the present invention.
Figure 19:
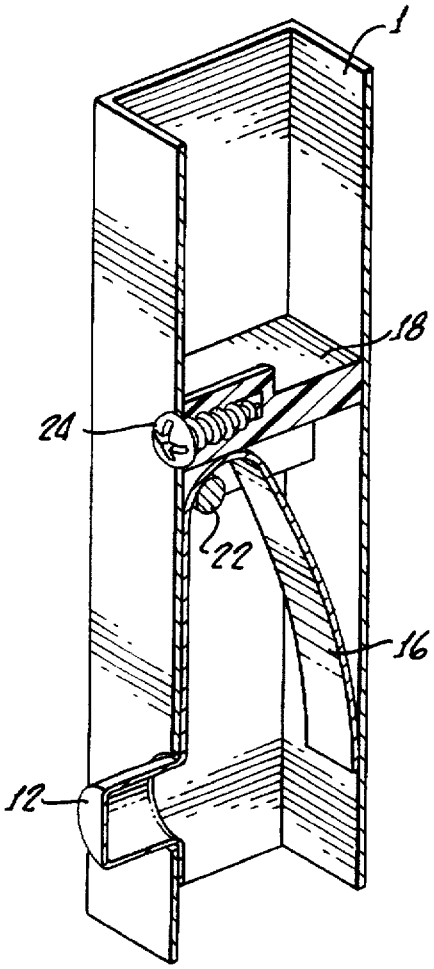
FIG. 19 is an exploded view of the locking assembly shown in FIG. 18.

As shown by way of example in FIGS. 18 and 19, the poles 1 may include a locking assembly 10 which locks the sliding connector 6 in place when it reaches the location shown in FIG. 1. Each locking assembly 10 consists of a button 12 that is forced through an aperture 14 in the pole 1 by a spring 16 to which the button is attached. The spring 16, which includes spring members **16*a* and 16*b* extending from a base member 16*c*, is maintained in the proper location within the pole 1 by a positioning member 18. A channel 20 is formed in the positioning member 18 and a post 22 extends across the channel such that a portion of the spring base member 16*c* can be held between the post and the top of the channel. The positioning member 18 is secured to the pole 1 by a screw 24 (or other mechanical fastener) which extends through an aperture 26 in the pole into an aperture 28** in the positioning member.

Figure 10:
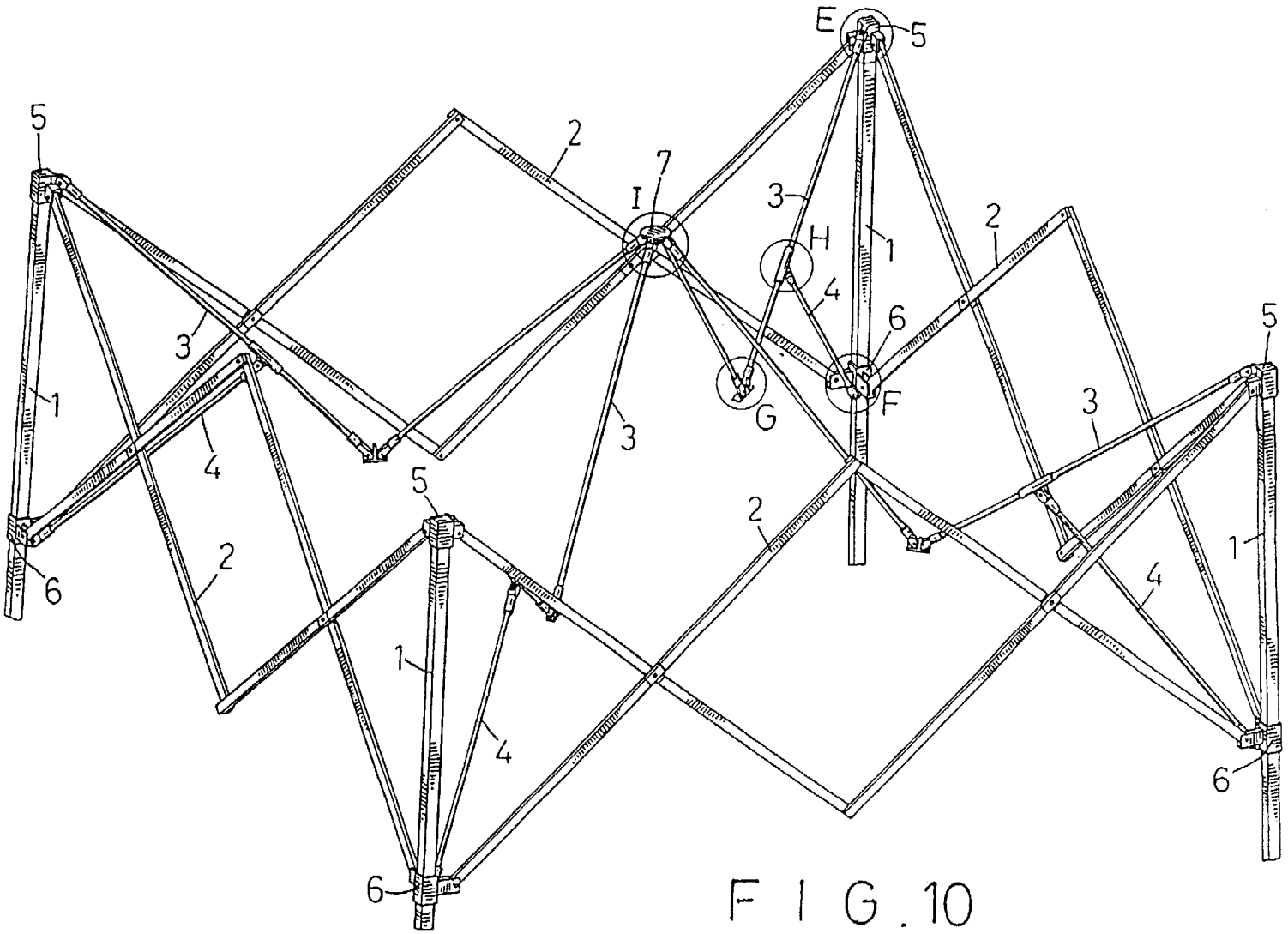
FIG. 10 is a perspective view of the preferred embodiment shown in FIG. 1 in a partially folded orientation.
Figure 11:
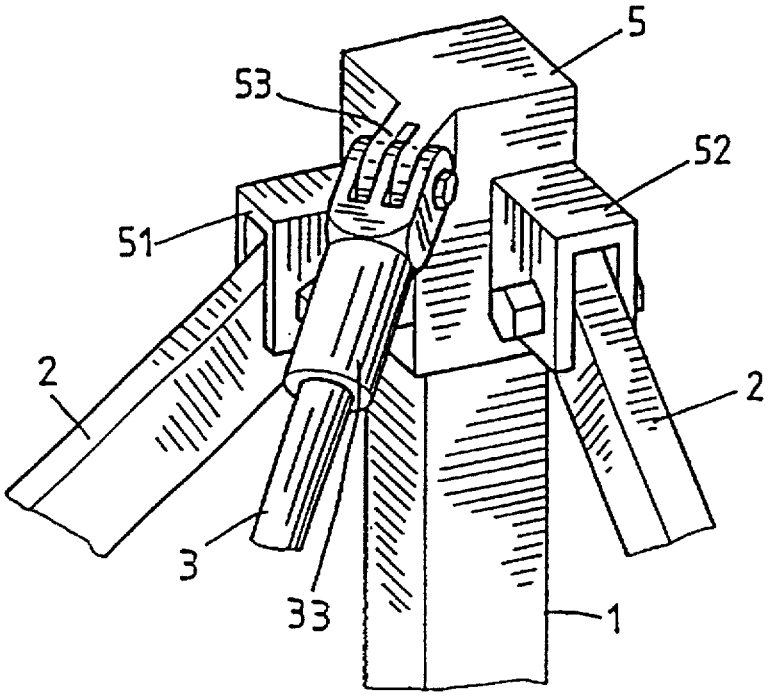
FIG. 11 is an enlarged view of the portion of the preferred embodiment identified by circle E in FIG. 10.
Figure 12:
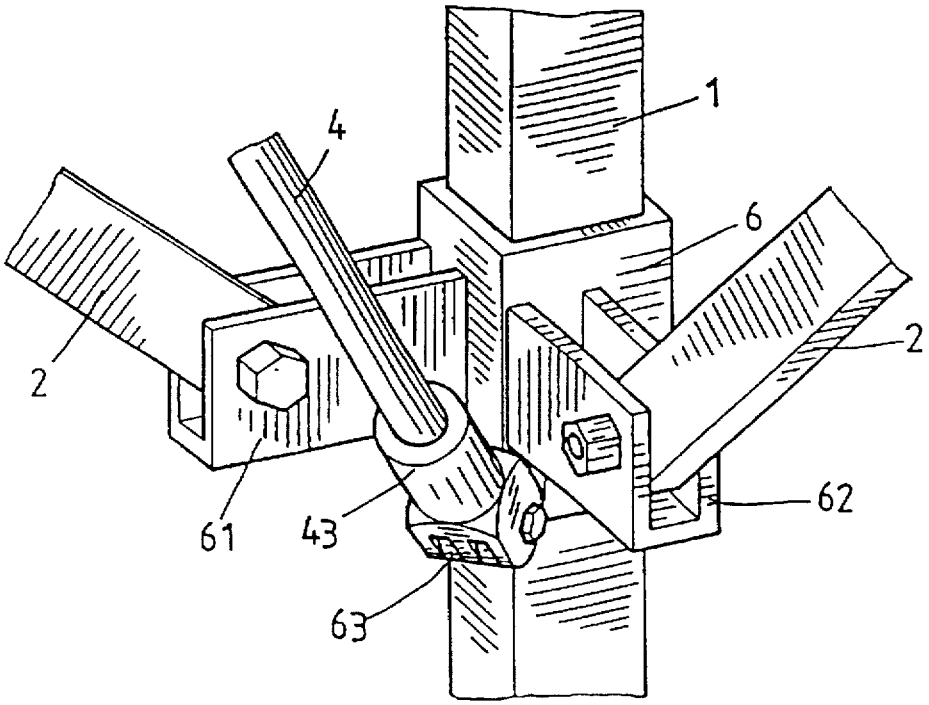
FIG. 12 is an enlarged view of the portion of the preferred embodiment identified by circle F in FIG. 10.

In operation, the button 12 is depressed as the sliding connector 6 moves from the unlocked position shown in FIG. 10 to the locked position shown in FIG. 1. Such depression may be accomplished manually, or by means of a cam surface on the bottom side of the button 12. Once the button is depressed, the sliding connector 6 will pass over the button until a corresponding aperture on the sliding connector (not shown) is aligned with the button. The button 12 will then be forced by the spring 16 through the sliding connector aperture, thereby locking the sliding connector in place. The button 12 may be depressed to release the sliding member 6 when the user desires to fold the frame.

Figure 3:
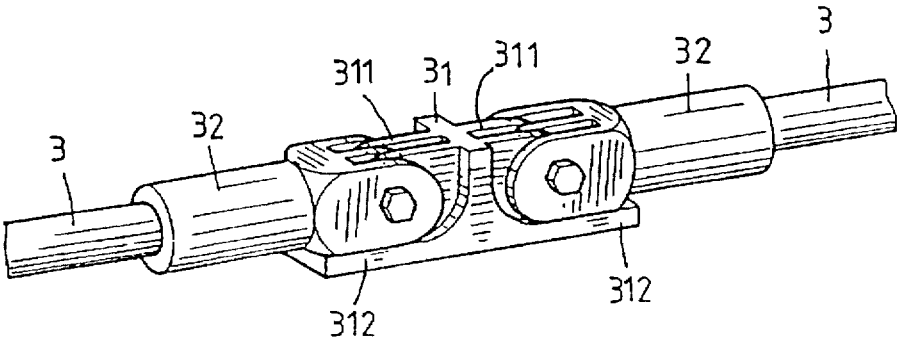
FIG. 3 is an enlarged view of the portion of the preferred embodiment identified by circle B in FIG. 1.
Figure 7:
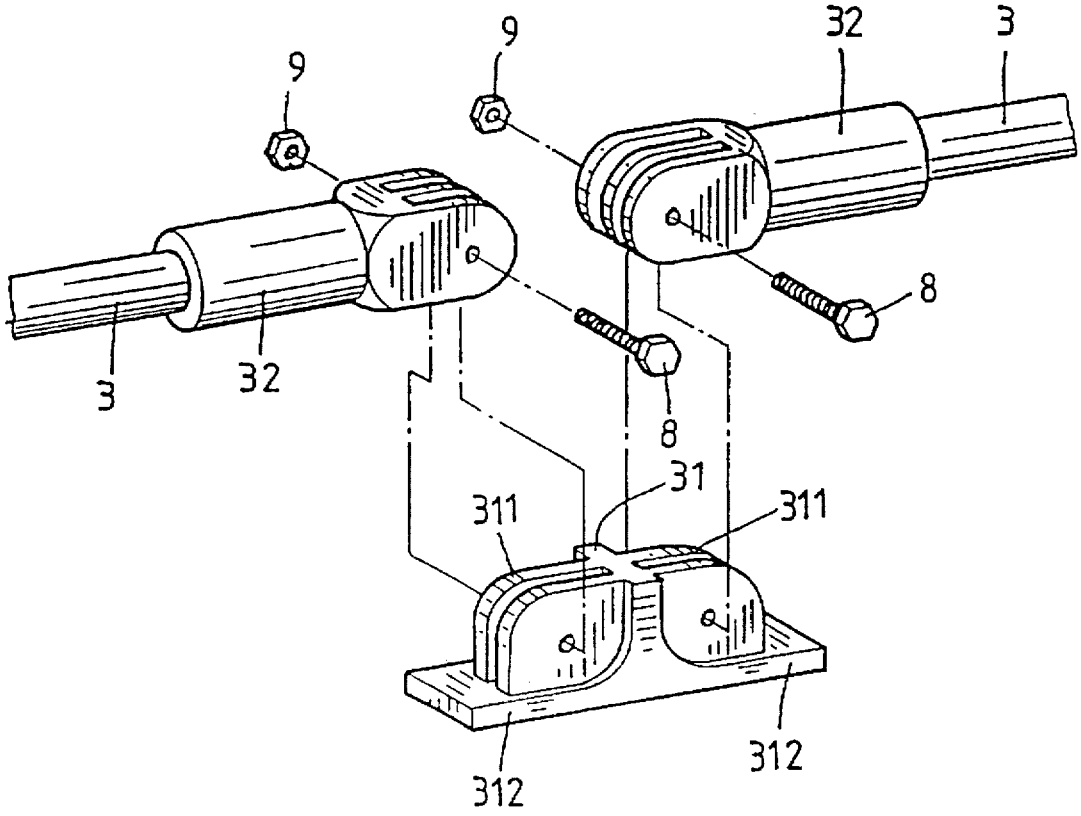
FIG. 7 is an exploded view of the portion of the preferred embodiment shown in FIG. 3.
Figure 13:
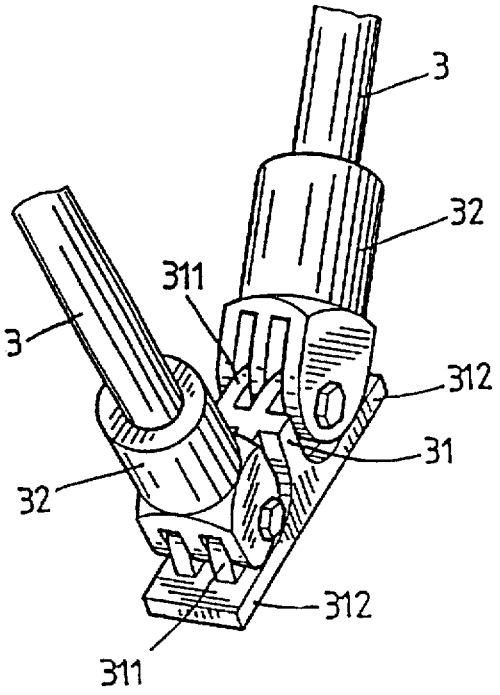
FIG. 13 is an enlarged view of the portion of the preferred embodiment identified by circle G in FIG. 10.

Turning to the exemplary canopy support shown in FIGS. 3, 7 and 13, each canopy support rod 3 consists of two rod members pivotally connected to one another by an intermediate pivot connector 31. The intermediate pivot connector 31 includes a pair of pivot members 311, which are secured to the ends 32 of the rod members by nuts 9 and bolts 8. The pivot members are composed of two parallel walls which mate with the three parallel walls of the rod ends 32. The intermediate pivot connector also includes a pair of stop boards 312 which prevent the rod members from pivoting past the unfolded orientation shown in FIGS. 1 and 3.

Figure 5:
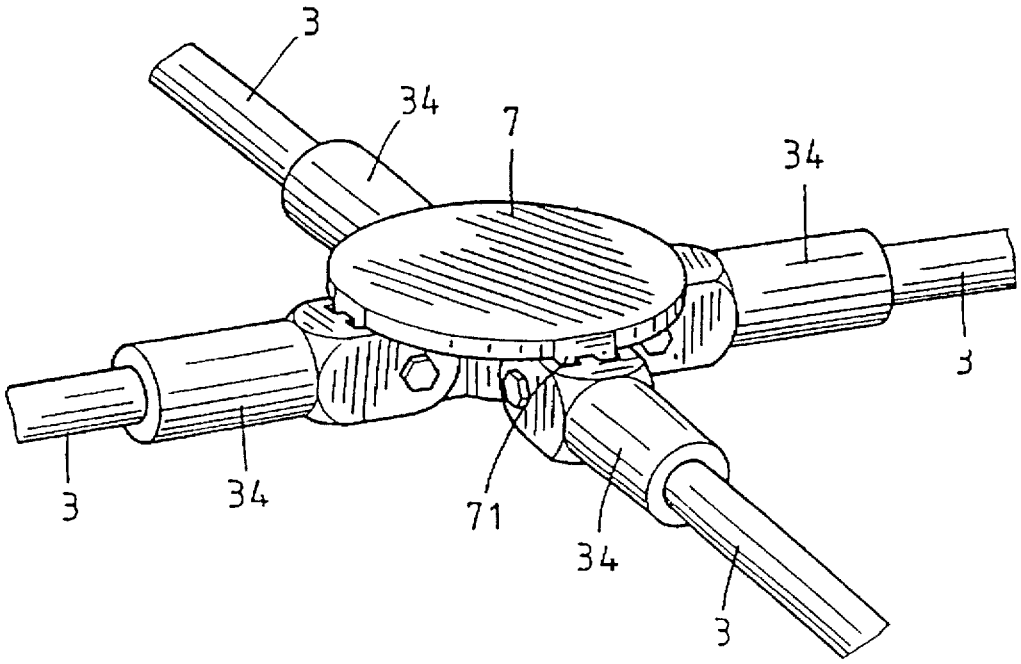
FIG. 5 is an enlarged view of the portion of the preferred embodiment identified by circle D in FIG. 1.
Figure 6:
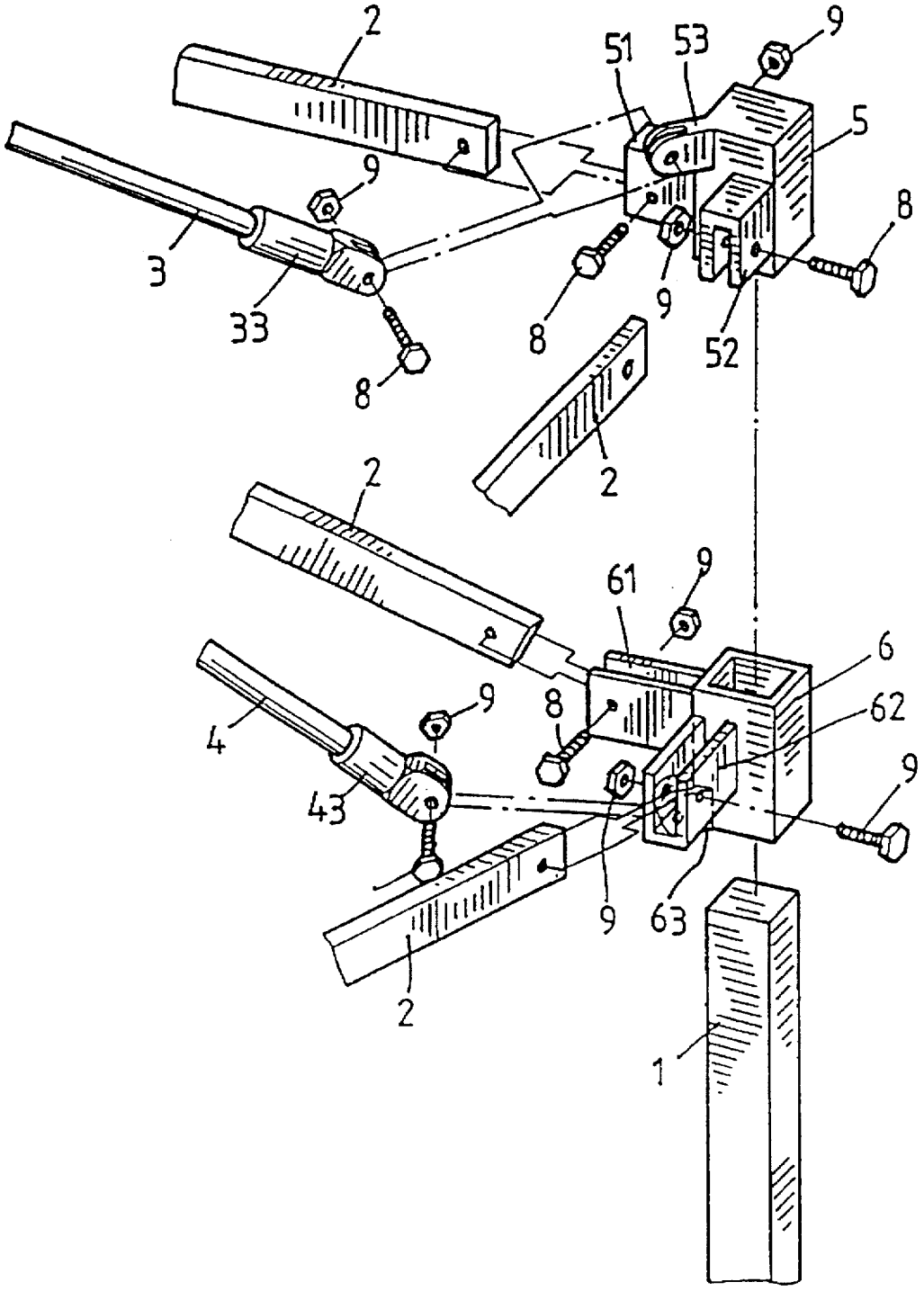
FIG. 6 is an exploded view of the portion of the preferred embodiment shown in FIG. 2.
Figure 9:
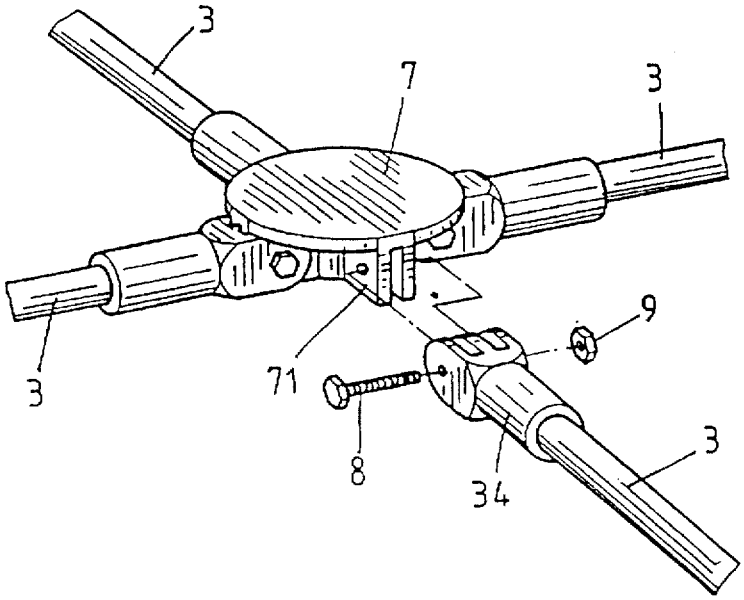
FIG. 9 is an exploded view of the portion of the preferred embodiment shown in FIG. 5.
Figure 15:
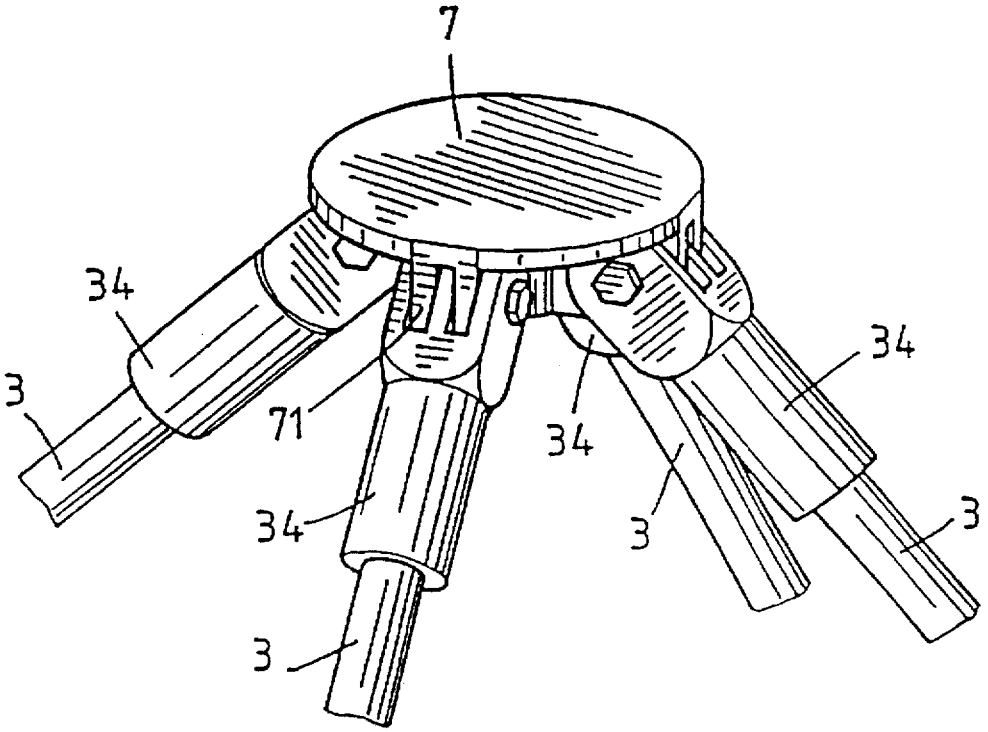
FIG. 15 is an enlarged view of the portion of the preferred embodiment identified by circle I in FIG. 10.

As noted above, one end of each canopy support rod 3 is secured to a fixed linkage 5 and the other end is secured to the head 7. Referring more specifically to FIGS. 5, 9 and 15, the preferred head 7 includes four head connectors 71, each of which consists of a pair of parallel walls that mate with the three parallel walls on the rod member ends 34. The connectors 71 are secured to the rod member ends 34 by a nut 9 and a bolt 8.

Figure 4:
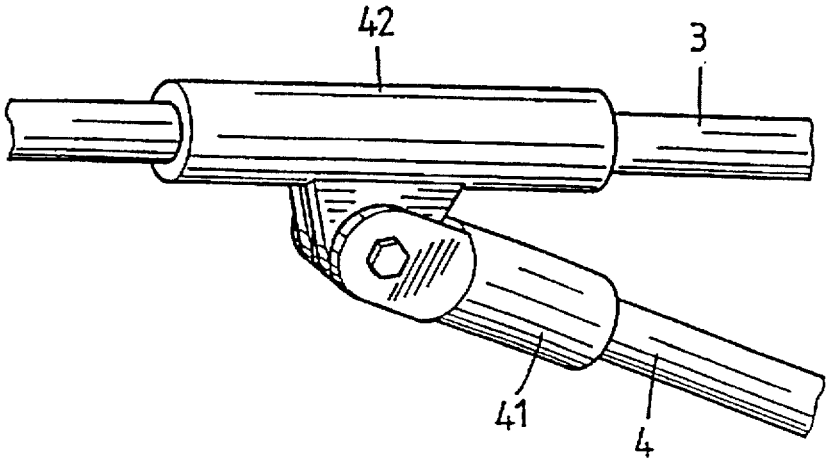
FIG. 4 is an enlarged view of the portion of the preferred embodiment identified by circle C in FIG. 1.
Figure 8:
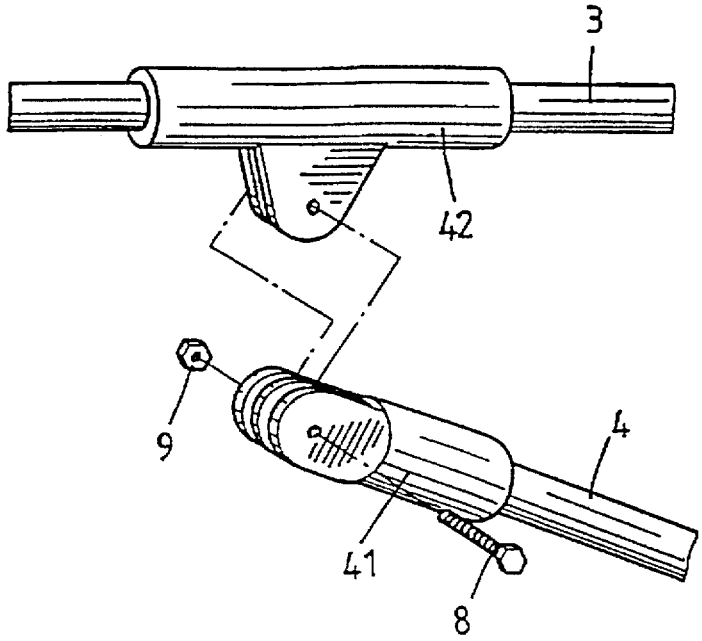
FIG. 8 is an exploded view of the portion of the preferred embodiment shown in FIG. 4.
Figure 14:
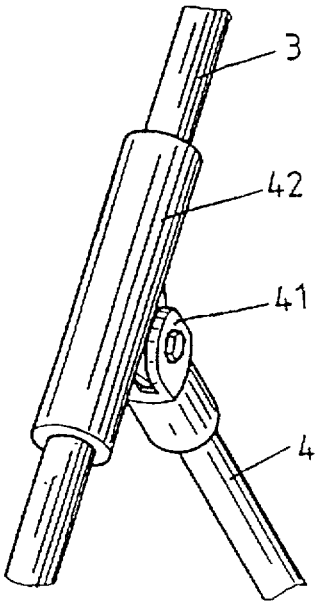
FIG. 14 is an enlarged view of the portion of the preferred embodiment identified by circle H in FIG. 10.

As illustrated for example in FIGS. 4, 8 and 14, one end of each linking rod 4 is pivotally and slidably connected to the corresponding canopy support rod 3 by an end connector 41 and a sliding connector 42. The end connector 41 includes three parallel walls which mate with a pair of parallel walls on the sliding connector 42. A nut 9 and a bolt 8 may be used to secure the assembly. The other end of each linking rod 4 includes a connector 43 that is secured to a respective sliding connector 6 in the manner described above.

Figure 20:
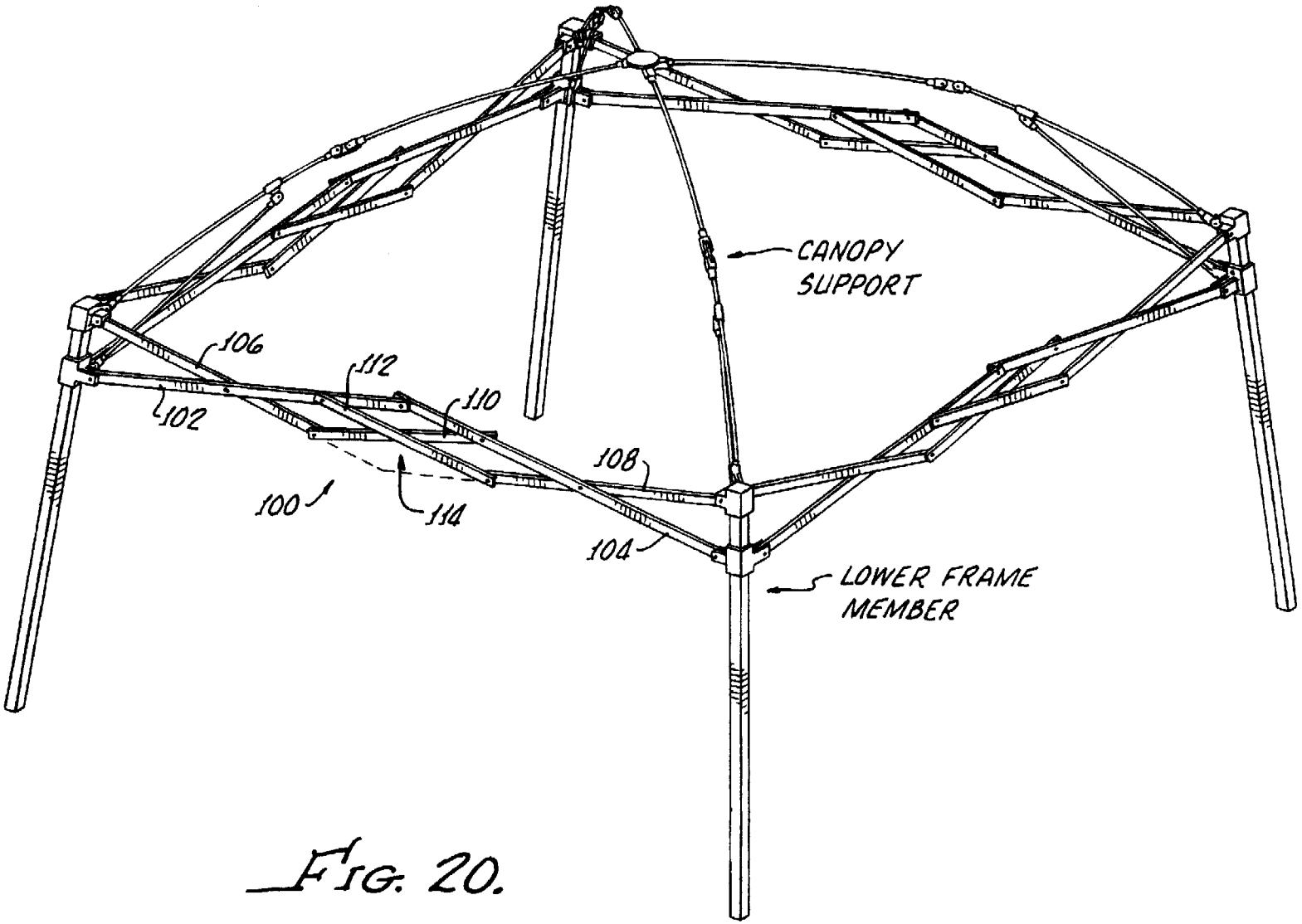
FIG. 20 is a perspective view in accordance with a second preferred embodiment of the present invention.
Figure 21:
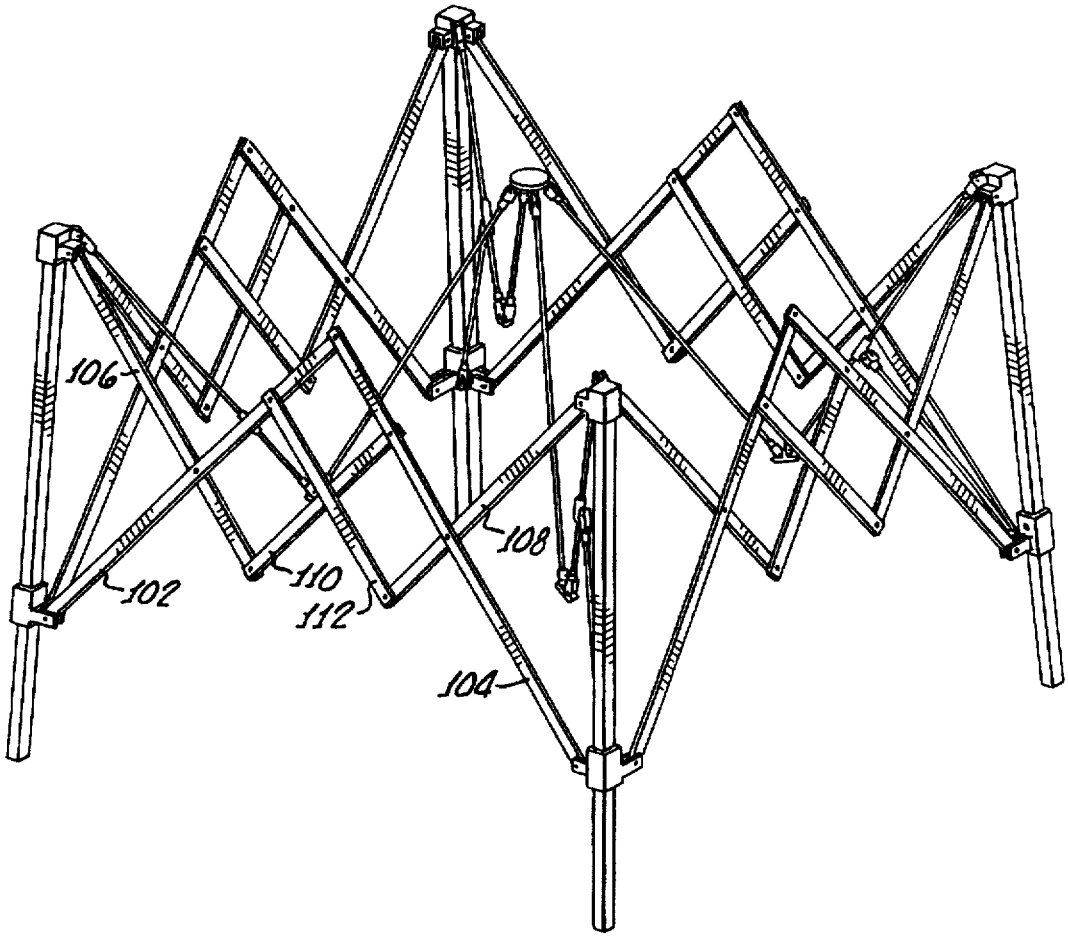
FIG. 21 is a perspective view of the preferred embodiment shown in FIG. 20 in a partially folded orientation.

One or all of the scissors-type linkage pairs shown in FIGS. 1 and 10 may be replaced by a linkage assembly 100 which is illustrated, for example, in FIGS. 20 and 21. The linkage assembly 100 includes a pair of structural members 102 and 104 which are pivotally secured to one another and to respective sliding connectors 6 in the manner described above. A pair of structural members 106 and 108 are secured to respective fixed connectors 5. The structural members 102–108 form two scissors-type linkages and operate in the scissor-like manner described above. In order to eliminate the relatively low connection point associated with the structure shown in FIGS. 1 and 10 (shown in dashed lines in FIG. 20), linkage assembly 100 also includes a linking device in the form of a pair of linking members 110 and 112. Linking member 110 extends from the free end of structural member 106 to structural member 104 and linking member 112 extends from the free end of structural member 108 to structural member 102. This configuration results in a shelter frame having more headroom at point 114 midway between the poles, which is often the location of the entrance to the shelter.

Figure 16:
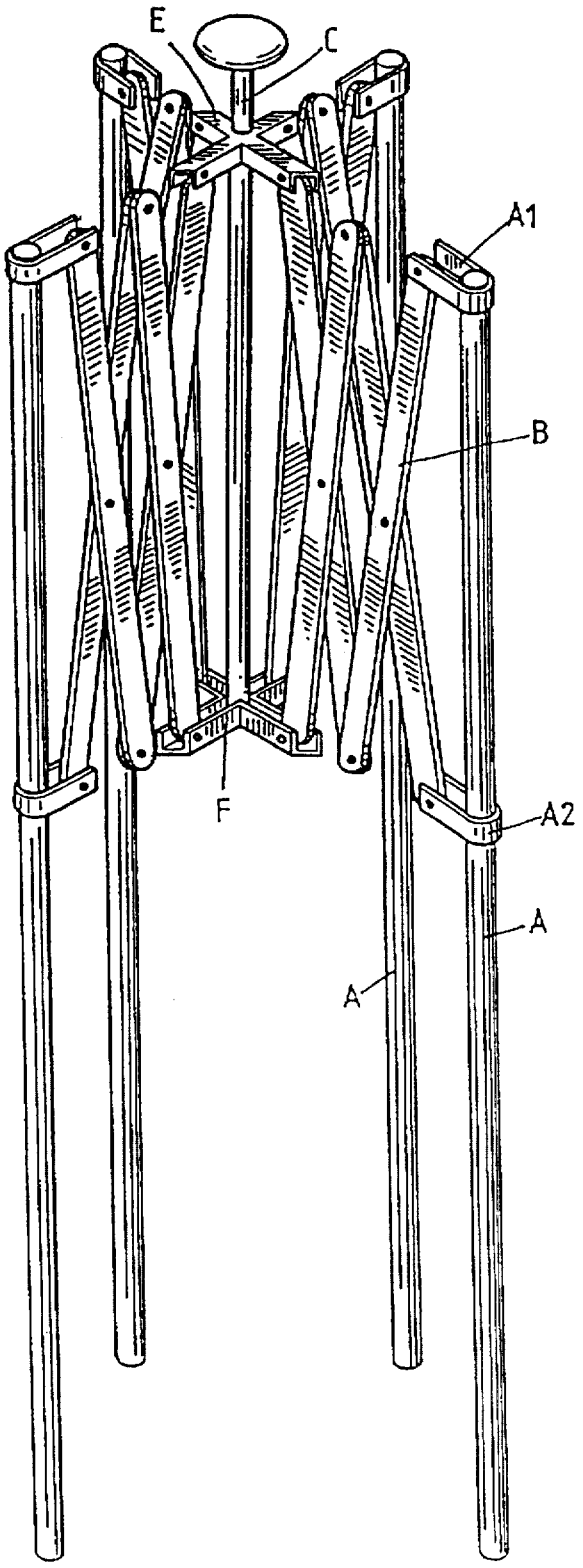
FIG. 16 (PRIOR ART)
FIG. 16 is a perspective view of a prior collapsible shelter frame in a folded orientation.
Figure 17:
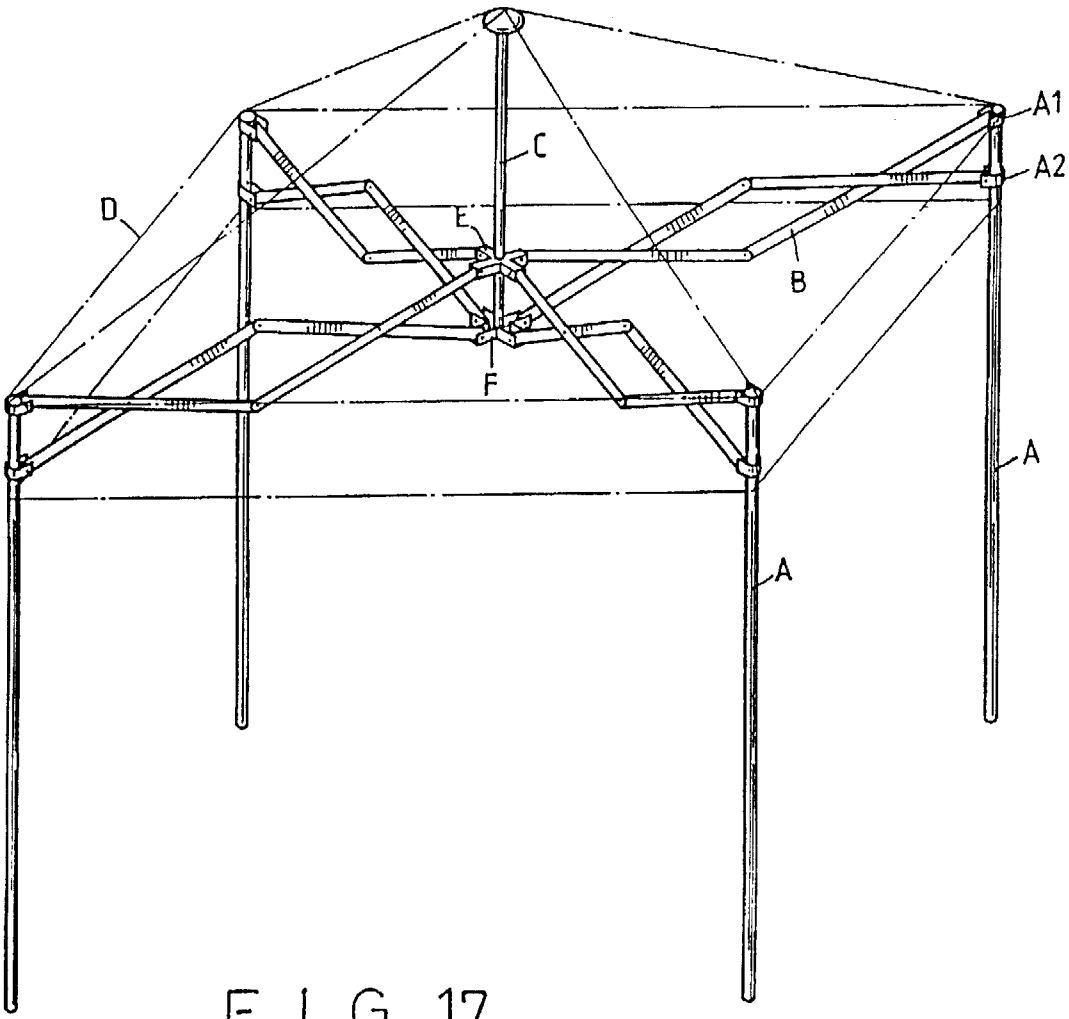
FIG. 17 (PRIOR ART)
FIG. 17 is a perspective view of the prior collapsible shelter frame shown in FIG. 16 in an unfolded orientation.
Figure 22:
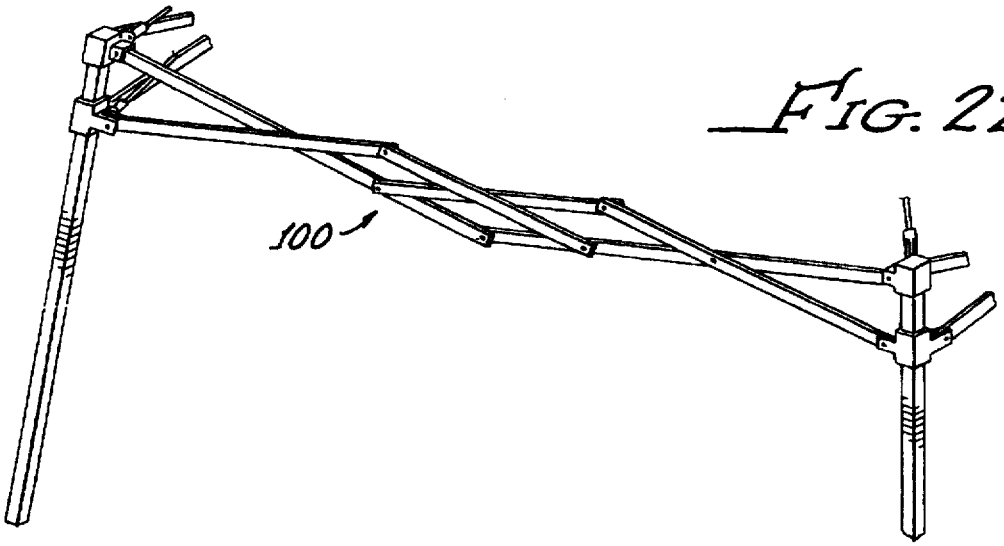
FIG. 22 is a partial perspective view in accordance with a third preferred embodiment of the present invention.

As shown by way of example in FIG. 22, the linkage assembly 100 shown in FIGS. 20 and 21 may be inverted. Such orientation results in a shelter frame that has greater structural rigidity and stability than the conventional frame shown in FIGS. 16 and 17. Another method of increasing structural rigidity and stability is to configure the frame such that the poles 1 slope inwardly (i.e. toward the head 7) as shown in FIGS. 1, 20 and 22.

The present shelter frame may be readily assembled, erected (i.e. unfolded) for use and folded for storage and transport. Referring to FIG. 10, which shows the frame in a partially folded state, the present frame may be erected by manually pulling the four poles 1 outwardly such that the scissors-type linkages 2 urge the sliding connectors 6 upwardly. As a result, the linking rods 4 will drive the associated canopy support rods 3 upwardly as the connector 42 slides therealong. This will continue until the pivot members 31 and head 7 reach the stable orientation shown in FIG. 1. The sliding connectors 6 will be locked in place by the locking assemblies 10. In other words, the canopy support will be automatically driven upwardly into its use orientation when the poles 1 are pulled outwardly. Similarly, the frame may be folded by pressing the locking assembly buttons 12 and then pushing the poles 1 inwardly, thereby causing the scissors-type linkages 2 to urge the sliding connectors 6 downwardly. The linking rods 4 will then cause the canopy support rods 3 to pivot about their intermediate pivot members 31 until the rod members in each support rod meet one another.

Although the present invention has been described in terms of the preferred embodiment above, numerous modifications and/or additions to the above-described preferred embodiments would be readily apparent to one skilled in the art. By way of example, but not limitation, the nuts 9 and bolts 8 may be replaced by any other suitable mechanical fastener. The overall rectangular shape of the frame may also be changed to a triangle or octagon. It is intended that the scope of the present invention extends to all such modifications and/or additions and that the scope of the present invention is limited solely by the claims set forth below.

What is claimed is:

1. A shelter frame, comprising:

at least first and second upwardly extending poles; and a linkage assembly linking the first and second poles, the linkage assembly including first and second scissors-type linkages each having respective first structural members pivotally coupled to respective second structural members, the first structural member in the first scissors-type linkage being pivotally coupled to the first structural member in the second scissors-type linkage, and a linking device pivotally secure a predetermined portion of the second structural member in the first scissors-type linkage to the second scissors-type linkage at a point on the second scissors-type linkage vertically spaced from the predetermined portion of the second structural member in the first scissors-type linkage and to pivotally secure a predetermined portion of the second structural member in the second scissors-type linkage to the first scissors-type linkage at a point on the first scissors-type linkage vertically spaced from the predetermined portion of the second structural member in the second scissors-type linkage.

2. A shelter frame as claimed in claim 1, wherein the first structural members are a first predetermined length, the second structural members are a second predetermined length, and the first predetermined length is substantially greater than the second predetermined length.

3. A shelter frame as claimed in claim 1, wherein the second structural members define first ends pivotally secured to a respective pole and second free ends, and the linking device is pivotally secured to the second free ends of the second structural members.

4. A shelter frame as claimed in claim 3, wherein the linking device comprises a first linking member pivotally secured to the free end of the second structural member in the first scissors-type linkage and to the first structural member in the second scissors-type linkage, and a second linking member pivotally secured to the free end of the second structural member in the second scissors-type linkage to the first structural member in the first scissors-type linkage.

5. A shelter frame as claimed in claim 1, wherein the linking device comprises a first linking member pivotally secured to the second structural member in the first scissors-type linkage and to the first structural member in the second scissors-type linkage, and a second linking member pivotally secured to the second structural member in the second scissors-type linkage to the first structural member in the first scissors-type linkage.

6. A shelter frame as claimed in claim 1, wherein the first and second structural members in the first scissors-type linkage are pivotally connected at a first pivot point, the first and second structural members in the second scissors-type linkage are pivotally connected at a second pivot point, the first structural members are pivotally connected to one another at a third pivot point, and the linking device is pivotally connected to first structural member of the first scissors-type linkage at a fourth pivot point located between the first and third pivot points.

7. A shelter frame as claimed in claim 6, wherein the linking device is pivotally connected to first structural member of the second scissors-type linkage at a fifth pivot point located between the second and third pivot points.

8. A shelter frame as claimed in claim 1, wherein the first structural members are respectively pivotally secured to first and second sliding connectors to slide along the first and second poles, and the second structural members are respectively pivotally secured to first and second fixed connectors on the first and second poles.

9. A shelter frame as claimed in claim 1, wherein the first and second poles extend upwardly in respective first and second directions, and the first and second directions have respective horizontal and vertical components.

10. A shelter frame as claimed in claim 1, wherein the linkage assembly defines a first linkage assembly, the shelter frame further comprising:

third and fourth upwardly extending poles;

a second linkage assembly linking the second and third poles;

a third linkage assembly linking the third and fourth poles; and a fourth linkage assembly linking the first and fourth poles.

11. A shelter frame as claimed in claim 1, wherein the point on the second scissors-type linkage is above the predetermined portion of the second structural member in the first scissors-type linkage, and the point on the first scissors-type linkage is above the predetermined portion of the second structural member in the second scissors-type linkage.

12. A shelter frame as claimed in claim 1, wherein the point on the second scissors-type linkage is below the predetermined portion of the second structural member in the first scissors-type linkage, and the point on the first scissors-type linkage is below the predetermined portion of the second structural member in the second scissors-type linkage.

13. A shelter frame as claimed in claim 1, wherein the point on the second scissors-type linkage is substantially vertically aligned with the predetermined portion of the second structural member in the second scissors-type linkage, and the point on the first scissors-type linkage is substantially vertically aligned with the predetermined portion of the second structural member in the first scissors-type linkage.

14. A shelter frame, comprising:

at least first and second upwardly extending poles;

at least a first linkage assemblies linking the poles, the linkage assembly including first and second scissors-type linkages each having respective first structural members pivotally coupled to respective second structural members, the first structural member in the first scissors-type linkage being pivotally coupled to the first structural member in the second scissors-type linkage, and a linking device pivotally secure a predetermined portion of the second structural member in the first scissors-type linkage to the second scissors-type linkage at a point on the second scissors-type linkage vertically spaced from the predetermined portion of the second structural member in the first scissors-type linkage and to pivotally secure a predetermined portion of the second structural member in the second scissors-type linkage to the first scissors-type linkage at a point on the first scissors-type linkage vertically spaced from the predetermined portion of the second structural member in the second scissors-type linkage; and a canopy support including a head connector, and at least first and second canopy support rods, each support rod including a first rod member pivotally secured to a second rod member, the first rod members also pivotally secured to a respective pole and the second rod members also pivotally secured to the head connector.

15. A shelter frame as claimed in claim 14, further comprising:

third and fourth poles;

second, third and fourth linkage assemblies; and third and fourth canopy support rods.

16. A shelter frame as claimed in claim 14, wherein the first structural members are respectively pivotally secured to first and second sliding pole connectors to slide along the first and second poles, the second structural members are respectively pivotally secured to first and second fixed connectors on the first and second poles, and the first rod members are respectively pivotally secured to the first and second fixed connectors.

17. A shelter frame as claimed in claim 16, wherein the canopy support further includes at least first and second linking rods respectively pivotally secured to the first and second sliding connectors and to the first and second canopy support rods.

18. A shelter frame as claimed in claim 17, wherein the first and second linking rods are respectively pivotally secured to the first rod members of the first and second canopy support rods.

19. A shelter frame as claimed in claim 17, wherein the first and second linking rods are pivotally secured to the first and second canopy support rods by respective first and second sliding canopy support rod connectors.

20. A shelter frame as claimed in claim 14, wherein the first rod members are pivotally secured to the second rod members by respective pivot connectors, each pivot connector including wall members to prevent the first and second rod members from pivoting beyond a predetermined orientation.

21. A shelter frame as claimed in claim 14, wherein the first structural members are a first predetermined length, the second structural members are a second predetermined length, and the first predetermined length is substantially greater than the second predetermined length.

22. A shelter frame as claimed in claim 14, wherein the second structural members define first ends pivotally secured to a respective pole and second free ends, and the linking device is pivotally secured to the second free ends of the second structural members.

23. A shelter frame as claimed in claim 22, wherein the linking device comprises a first linking member pivotally secured to the free end of the second structural member in the first scissors-type linkage and to the first structural member in the second scissors-type linkage, and a second linking member pivotally secured to the free end of the second structural member in the second scissors-type linkage to the first structural member in the first scissors-type linkage.

24. A shelter frame as claimed in claim 14, wherein the linking device comprises a first linking member pivotally secured to the second structural member in the first scissors-type linkage and to the first structural member in the second scissors-type linkage, and a second linking member pivotally secured to the second structural member in the second scissors-type linkage to the first structural member in the first scissors-type linkage.

25. A shelter frame as claimed in claim 14, wherein the first and second structural members in the first scissors-type linkage are pivotally connected at a first pivot point, the first and second structural members in the second scissors-type linkage are pivotally connected at a second pivot point, the first structural members are pivotally connected to one another at a third pivot point, and the linking device is pivotally connected to first structural member of the first scissors-type linkage at a fourth pivot point located between the first and third pivot points.

26. A shelter frame as claimed in claim 25, wherein the linking device is pivotally connected to first structural member of the second scissors-type linkage at a fifth pivot point located between the second and third pivot points.

27. A shelter frame as claimed in claim 14, wherein the first structural members are respectively pivotally secured to first and second sliding connectors to slide along the first and second poles, and the second structural members are respectively pivotally secured to first and second fixed connectors on the first and second poles.

28. A shelter frame as claimed in claim 14, wherein the first and second poles extend upwardly in respective first and second directions, and the first and second directions have respective horizontal and vertical components.

29. A shelter frame as claimed in claim 14, wherein the point on the second scissors-type linkage is above the predetermined portion of the second structural member in the first scissors-type linkage, and the point on the first scissors-type linkage is above the predetermined portion of the second structural member in the second scissors-type linkage.

30. A shelter frame as claimed in claim 14, wherein the point on the second scissors-type linkage is below the predetermined portion of the second structural member in the first scissors-type linkage, and the point on the first scissors-type linkage is below the predetermined portion of the second structural member in the second scissors-type linkage.

31. A shelter frame as claimed in claim 14, wherein the point on the second scissors-type linkage is substantially vertically aligned with the predetermined portion of the second structural member in the second scissors-type linkage, and the point on the first scissors-type linkage is substantially vertically aligned with the predetermined portion of the second structural member in the first scissors-type linkage.

* * * * *